United States Patent [19]

Vacha

[11] 4,212,388

[45] Jul. 15, 1980

[54] PORTABLE RUST INHIBITOR APPLICATOR FOR A VEHICLE

[76] Inventor: Fred P. Vacha, 226 Lombardy Ave., Fort Lauderdale, Fla. 33308

[21] Appl. No.: 953,085

[22] Filed: Oct. 20, 1978

[51] Int. Cl.[2] ..... B65D 69/00; B65D 71/00

[52] U.S. Cl. ..... 206/230; 206/223; 206/527

[58] Field of Search ..... 206/230, 229, 223, 373, 206/568, 582, 527

[56] References Cited

U.S. PATENT DOCUMENTS

| | | | |
|---|---|---|---|
| 2,990,944 | 7/1961 | Bomberger | 206/229 |
| 3,212,677 | 10/1965 | Hronas | 266/527 |
| 3,272,323 | 9/1966 | Ewry | 206/229 |
| 3,342,369 | 9/1967 | Randorf | 206/230 |

*Primary Examiner*—Herbert F. Ross

*Attorney, Agent, or Firm*—Malin & Haley

[57] ABSTRACT

An applicator in kit form for spraying a rust inhibitor to the inside surfaces of the body of a vehicle.

The applicator kit includes a flexible tube joined in fluid communication with a rigid nozzle to direct inhibitor spray to otherwise inaccessible surface areas. A metal punch and plug are included.

5 Claims, 5 Drawing Figures

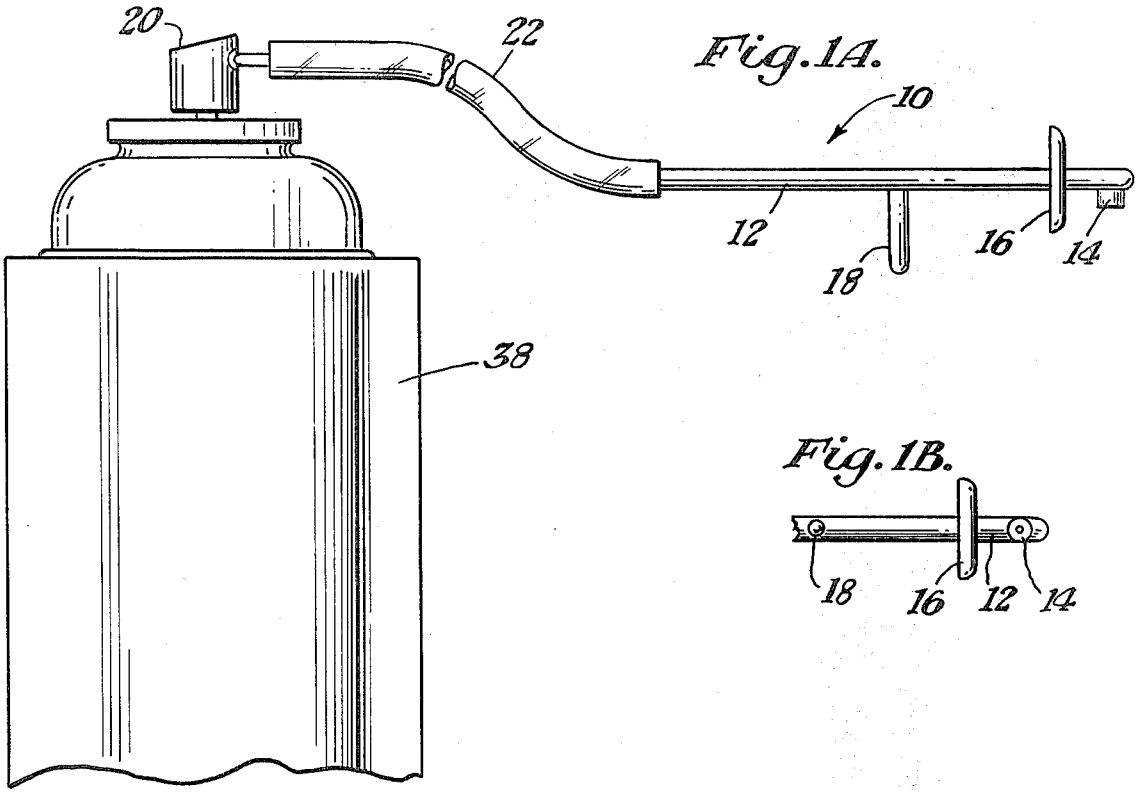
Fig. 1A.
Fig. 1B.
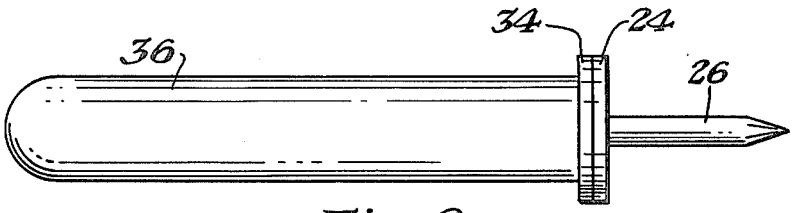
Fig. 2.
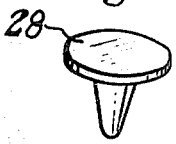
Fig. 3.
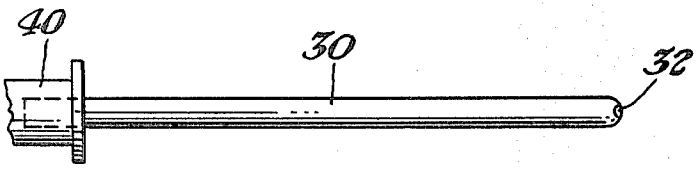
Fig. 4.

PORTABLE RUST INHIBITOR APPLICATOR FOR A VEHICLE

BACKGROUND OF THE INVENTION

This invention relates generally to a portable kit which is used in conjunction with an aeorsol spray container which allows one to apply a rust inhibitor disposed in the aerosol container from outside to the inside surfaces of an automobile body which otherwise would not be readily accessible.

The application of a rust inhibitor to automobiles or other vehicles is known. It is not uncommon to see, however, not only many older, but some relatively new vehicles with rust spots originating from the inside surface of the vehicle body. Normally, the manufacturer does not thoroughly protect the vehicle body during the manufacturing process by applying rust inhibitors at strategic locations which are not readily accessible to the vehicle owner. Certain commercial ventures have processes that allows a vehicle to be rust-proofed, for a limited time only, with elaborate spray machinery and the like, and at considerable cost.

While wax and other coatings can be applied to protect the outside surfaces of a car's body, the present invention provides a complete do-it-yourself kit so that the unskilled vehicle owner may rust-proof the inside surfaces of the vehicle body from the outside alone using an aerosol spray container of the rust inhibitor which may be applied strategically throughout the vehicle.

BRIEF DESCRIPTION OF THE INVENTION

A kit, which is useful for allowing a vehicle owner to apply rust inhibiting liquid to inside, inaccessible surfaces of the vehicle body comprising a metal punch for applying a small hole in the body surface of the vehicle and a fluid conduit having a nozzle or spraying aperture which sprays at a 90-degree angle to the longitudinal axis of a conduit, the nozzle being positioned adjacent one end of the conduit, a handle projecting from the exterior surface of the conduit which allows for manipulative rotation of the conduit, an annular stop disposed near the nozzle for limiting the travel of the conduit inside the car body, and a flexible tube used to connect the conduit to the pressurized container outlet.

To utilize the invention, the conduit is affixed to the flexible tube, which is attached to the nozzle opening of a conventional aerosol spray container, housing the rust inhibitor. The punch is utilized to form a small opening at a particular location along the vehicle body, the inside of which is to be sprayed. The end of the conduit having the nozzle is then positioned within the hole in the vehicle body and the spray actuated such as by pushing the nozzle on the aerosol container. During the spraying operation, the handle is used to rotate the nozzle to achieve any desired spray pattern up to 360 degrees. A small plug may be used to plug the hole after the spray operation is complete to prevent moisture from being received into the car body at a later time.

BRIEF DESCRIPTION OF THE DRAWING

FIG. 1*a* shows the spray adaptor in a side elevational view partially in cross-section. FIG. 1*b* shows a fragmentary bottom plan view of the nozzle opening of the spray adapter.

FIG. 2 shows a punch for punching a hole in metal utilized with the instant invention.

FIG. 3 shows a plug in a perspective view utilized with the instant invention.

FIG. 4 shows an alternate spray nozzle for use with the instant invention.

PREFERRED EMBODIMENT OF THE INVENTION

Referring now to the drawings and especially FIGS. 1*a* and 1*b*, the invention is shown generally at 10 comprised of a rigid conduit 12 having a nozzle 14 disposed at a 90 degree angle to the longitudinal axis of the conduit, and a stop 16 disposed near the nozzle end of conduit 12. A handle 18 projects from the conduit 12 which is used to rotate the conduit during the operation of the device. The flexible tube 22 is connected at one end of the conduit 12 and at the other end to a conventional aerosol spray outlet 20 affixed to pressurized container 38 holding a rust inhibitor.

FIG. 2 shows a punch 36 having a resilient washer 24, a stop 34 and a sharp pointed end 26 for achieving a hole in a piece of metal.

FIG. 3 shows a plug 28 sized to fit firmly yet inconspicuously in a hole punched with the punch shown in FIG. 2.

To operate the device, the punch shown in FIG. 2 is used to punch a small hole sized slightly larger in diameter than the nozzle and conduit end into the vehicle body, especially where rust appears to have formed from underneath.

The nozzle 14 is then inserted within the hole and the aerosol spray container actuated, causing the rust inhibitor to be sprayed from the nozzle. During this operation the handle is rotated to allow for any desired spray coverage up to 360 degrees within the vehicle body surface.

After the spraying is completed, a plug 28 as shown in FIG. 3 is then tapped into the hole.

FIG. 4 shows an additional longer nozzle adapter that may be included in the kit comprised of elongated rigid conduit 30 having a nozzle opening 32 along the longitudinal axis of conduit 30. A flexible tube 40 connects the conduit 30 with the pressurized container (not shown in FIG. 4).

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A rust inhibitor applicator kit for applying the rust inhibitor to relatively inexcessible surfaces of a vehicle body or the like, comprising:

a pressurized container with a rust inhibitor, said container having an outlet for dispensing said rust inhibitor;

a conduit having a longitudinal axis and a first end and a second end, said first end being open and said second end including a nozzle aperture disposed adjacent said second end, said nozzle aperture being positioned at a predetermined angle relative to the longitudinal axis of said conduit;

a flexible tube attachable at one end to the first end of said conduit and connectable at said tube opposite end to the outlet of said pressurized container having rust inhibitor disposed therein; and means for punching a relatively small hole in a vehicle body surface, said hole being sized to receive said second end of said conduit to allow insertion of the conduit nozzle aperture disposed adjacent the end of said conduit through said body surface.

2. An applicator kit as in claim 1, including: means projecting from said conduit to allow manual rotation of said conduit.

3. An applicator kit as in claim 1, including:

means connected to said conduit adjacent and in proximal relationship to said conduit nozzle aperture for limiting the penetration of said conduit through said small hole.

4. An applicator kit as in claim 1, including:

a plug sized to fit within said small hole made by said punching means for plugging the hole after the rust inhibitor has been applied.

5. An applicator kit as in claim 4, including:

a second conduit having a longitudinal axis and a first end opening connectable to one end of said flexible tube, and a nozzle aperture disposed along the longitudinal axis of said second conduit at the opposite end.

* * * * *